US009847157B1

(12) United States Patent
Rowe et al.

(10) Patent No.: US 9,847,157 B1
(45) Date of Patent: Dec. 19, 2017

(54) FERROMAGNETIC β-MNBI ALLOY

(71) Applicants: Toyota Motor Engineering & Manufacturing North America, Inc., Erlanger, KY (US); The University of Manitoba, Winnipeg (CA)

(72) Inventors: Michael Paul Rowe, Pinckney, MI (US); Elizabeth Marie Skoropata, Winnipeg (CA); Johan Alexander van Lierop, Winnipeg (CA)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 15/275,334

(22) Filed: Sep. 23, 2016

(51) Int. Cl.

| | |
|---|---|
| ***B22F 9/24*** | (2006.01) |
| ***H01F 1/03*** | (2006.01) |
| ***B22F 1/00*** | (2006.01) |
| ***C22F 1/16*** | (2006.01) |
| ***B22F 9/04*** | (2006.01) |
| ***C22C 22/00*** | (2006.01) |

(52) U.S. Cl.
CPC ..... *H01F 1/03* (2013.01); *B22F 1/0085* (2013.01); *B22F 9/04* (2013.01); *C22C 22/00* (2013.01); *C22F 1/16* (2013.01); *B22F 2009/043* (2013.01)

(58) Field of Classification Search
CPC .. H01F 1/03; B22F 1/0085; B22F 9/04; B22F 2009/043; C22C 22/00; C22F 1/16
See application file for complete search history.

(56) References Cited

U.S. PATENT DOCUMENTS

| | | | |
|---|---|---|---|
| 4,448,856 | A | 5/1984 | Zuckerbrod et al. |
| 5,145,752 | A | 9/1992 | Menachem et al. |
| 7,041,350 | B1 | 5/2006 | Rule et al. |
| 7,785,392 | B2 | 8/2010 | Shim et al. |
| 7,927,507 | B1 | 4/2011 | Li et al. |
| 8,192,866 | B2 | 6/2012 | Golightly et al. |
| 8,372,177 | B1 | 2/2013 | Thoma et al. |
| 8,395,003 | B2 | 3/2013 | Leger et al. |

(Continued)

FOREIGN PATENT DOCUMENTS

| | | |
|---|---|---|
| CN | 102909381 | 2/2013 |
| DE | 112012001928 T5 | 2/2014 |

(Continued)

OTHER PUBLICATIONS

Bandaru et al., "Decoupling the Structural and Magnetic Phase Transformations in Magneto-optic MnBi Thin Films the Partial Substitution of Cr for Mn", Appl. Phys. Lett., 1998, 1 pg, vol. 72, No. 2337. (Abstract Only).

(Continued)

*Primary Examiner* — Bernard Rojas
(74) *Attorney, Agent, or Firm* — Christopher G. Darrow; Darrow Mustafa PC

(57) ABSTRACT

A novel ferromagnetic phase of manganese-bismuth alloy has an NiAs-type unit cell structure, similar to that of Low Temperature Phase manganese-bismuth, but with manganese atoms populating interstitial sites. The novel phase, termed β-MnBi, possesses maximum magnetic coercivity at unusually high temperature. A method for forming β-MnBi includes annealing MnBi nanoparticles, for example by hot compaction, at temperature lower than 175° C.

9 Claims, 6 Drawing Sheets

(56) References Cited

U.S. PATENT DOCUMENTS

| | | | | |
|---|---|---|---|---|
| 8,980,219 | B1 | 3/2015 | Rowe et al. | |
| 9,142,834 | B2 | 9/2015 | Mohtadi et al. | |
| 9,278,392 | B2 * | 3/2016 | Rowe | B22F 9/24 |
| 2005/0217427 | A1 | 10/2005 | Suthersan et al. | |
| 2009/0011297 | A1 | 1/2009 | Jang et al. | |
| 2009/0029148 | A1 | 1/2009 | Hashimoto et al. | |
| 2009/0029206 | A1 | 1/2009 | Jung et al. | |
| 2009/0090214 | A1 | 4/2009 | Cheng | |
| 2009/0264277 | A1 | 10/2009 | Raj et al. | |
| 2010/0021799 | A1 | 1/2010 | Rieke et al. | |
| 2011/0223480 | A1 | 9/2011 | Wee et al. | |
| 2012/0094178 | A1 | 4/2012 | Loveridge et al. | |
| 2012/0235077 | A1 * | 9/2012 | Iftime | H01F 1/0054 252/62.54 |
| 2013/0084502 | A1 | 4/2013 | Singh et al. | |
| 2013/0157133 | A1 | 6/2013 | Chen et al. | |
| 2013/0157147 | A1 | 6/2013 | Li et al. | |
| 2014/0132376 | A1 * | 5/2014 | Jin | C22C 38/10 335/302 |
| 2015/0068646 | A1 | 3/2015 | Rowe | |
| 2015/0096887 | A1 | 4/2015 | McDonald et al. | |
| 2015/0097649 | A1 | 4/2015 | Rowe | |
| 2015/0098882 | A1 | 4/2015 | Rowe | |
| 2015/0098884 | A1 | 4/2015 | Rowe | |
| 2015/0098885 | A1 | 4/2015 | Rowe | |
| 2015/0098886 | A1 | 4/2015 | Rowe et al. | |
| 2015/0098892 | A1 | 4/2015 | Rowe et al. | |
| 2015/0099117 | A1 | 4/2015 | Rowe et al. | |
| 2015/0099118 | A1 | 4/2015 | Mizuno et al. | |
| 2015/0099135 | A1 | 4/2015 | Mohtadi et al. | |
| 2015/0099172 | A1 | 4/2015 | Rowe et al. | |
| 2015/0099182 | A1 | 4/2015 | Singh et al. | |
| 2015/0099183 | A1 | 4/2015 | Singh et al. | |
| 2015/0110664 | A1 | 4/2015 | Choi et al. | |
| 2016/0035487 | A1 * | 2/2016 | Kim | C22F 1/16 419/33 |

FOREIGN PATENT DOCUMENTS

| | | | |
|---|---|---|---|
| JP | 2011122202 | A | 6/2011 |
| JP | 2012038697 | A | 2/2012 |
| JP | 2013073839 | A | 4/2013 |
| JP | 2013131366 | A | 7/2013 |
| JP | 2006152376 | A | 2/2016 |
| WO | 2011150212 | A1 | 12/2011 |
| WO | 2012007830 | A1 | 1/2012 |
| WO | 2013056185 | A1 | 4/2013 |
| WO | 2013063161 | A2 | 5/2013 |

OTHER PUBLICATIONS

Zou et al, "Size-dependent Melting Properties of Sn Nanoparticles by Chemical Reduction Synthesis", Trans. Nonferrous Met. Soc. China, 2010, pp. 248-253, vol. 20.

Brenner et al., "The Synthesis and Nature of Heterogeneous Catalysts of Low-Valent Tungsten Supported on Alumina", J. Atalysis, 1980, pp. 216-222, vol. 61.

Chen et al., "Improved Dehydrogenation Properties of Ca(BH4)2•nNH3 (n =1, 2, and 4) Combined with Mg(BH4)2,", Sep. 2012, J. Phys. Chem., pp. 21162-21168, vol. 116.

Chen et al., "Unique High-temperature Performance of Highly Condensed MnBi Permanent Magnets", Scripta Materialia, 2015, pp. 131-135, vol. 107.

Chen et al., "The Phase Transformation and Physical Properties fo the MnBi and Mn 1.08Bi Compounds", IEEE Trans. Magn., 1974, pp. 561-586, vol. 10.

Gambardella et al., "Electron Transfer Dynamics of Iridium Oxide Nanoparticles Attached to Electrodes by Self-Assembled Monolayers", J. Am. Chem. Soc., 2012, pp. 5774-5777, vol. 134, No. 13.

Göbel et al., "Properties of MnBi Compounds Partially Substituted with Cu, Zn, Ti, Sb, and Te. II. Stability and Magnetooptic Properties of Thin Films", May 1976, Physics Status Solidi, 2 pgs, vol. 35, No. 1. (Abstract Only).

Göbel et al., "Properties of MnBi compounds partially substituted with Cu, Zn, Ti, Sb, and Te. I. Formation of mixed phases and crystal structures", 1976, Physics Status Solidi, 2 pgs, vol. 34, vol. 2 (Abstract Only).

Harris, "X. Quantitative Measurement of Preferred Orientation in Rolled Uranium Bars", Sep. 26, 1951, pp. 113-123.

Imamura et al., "Dehydriding of Sn/MgH2 nanocomposite formed by ball milling of MgH2 with Sn", International Journal of Hydrogen Energy, Jul. 2007, pp. 4191-4194, vol. 32.

Kharel et al., "Structural, Magnetic, and Electron Transport Properties of MnBi:Fe Thin Films", 2012, J. Appl. Phys., 5 pgs, vol. 111.

Lu et al., "Lithium-oxygen batteries: bridging mechanistic understanding and battery performance", Energy Environ. Sci., 2013, pp. 750-768, vol. 6.

McCloskey et al., "Chemical and Electrochemical Differences in Nonaqueous Li—O2 and Na—O2 Batteries", J. Phys. Chem. Lett., 2014, pp. 1230-1235, vol. 5.

Peng et al., "A Reversible and Higher-Rate Li—O2 Battery", Science, Aug. 2012, pp. 563-566, vol. 337.

Poudyal et al.; "Advances in Nanostructured Permanent Magnets Research"; J. Phys. D: Appl. Phys., Dec. 2012, 23 pgs, vol. 46; No. 4.

Rowe et al., "MnBi Nanoparticles: Improved Magnetic Performance Through Annealing of As-synthesized Nanoparticles", May 2015, IEEE Spectrum: Magnetics Conference, ISBN: 978-1-4799-7321-7, 1 pg (Abtract Only).

Schüth et al., "Light Metal Hydrides and Complex Hydrides for Hydrogen Storage", Chem Commun, Sep. 2004, pp. 2249-2258, Issue 20.

Shen et al., "An Iridium Nanoparticles Dispersed Carbon Based Thick Film Electrochemical Biosensor and Its Application for a Single Use, Disposable Glucose Biosensor", Sensors and Actuators B Chemical, 2007, pp. 106-113, vol. 125, No. 1.

Shim et al., "Oxidation-state dependent electrocatalytic activity of iridium nanoparticals supported on graphene nanosheets", Phys. Chem. Chem. Phys., 2013, pp. 15365-15370, vol. 15.

Singh et al., "A High Energy-density Tin Anode for Rechargeable Magnesium-ion Batteries", Chem. Commun., 2013, pp. 149-151, vol. 49, RCS Publishing.

Singh et al., "Electronic Supplementary Material (ESI): A High Energy-Density Tin Anode for Rechargeable Magnesium-Ion Batteries", Electronic Supplementary Material (ESI) for Chemical Communications, Nov. 8, 2012, 4 pgs, RCS Publishing.

Suzuki et al. "Spin reorientation transition and hard magnetic properties of MnBi intermetallic compound", J. Appl. Phys., 2012, 3 pgs., vol. 111, Article No. 07E303.

Tauxe et al., "Potbellies, Wasp-waists, and Superparamagnetism in Magnetic Hysteresis", Jan. 1996, J. Geophys. Res., pp. 571-583, vol. 101, No. B1.

Thotiyl et al., "A Stable Cathode for the Aprotic Li—O2 battery", Nature Materials, Nov. 2013, pp. 1050-1056, vol. 12.

Valvo et al, "Electrospraying-assisted Synthesis of Tin Nanoparticles for Li-ion battery Electrodes", Journal of Power Sources, 2009, pp. 297-302, vol. 189.

Varin et al., "The Effects of Ball Milling and Nonmetric Nickel Additive on the Hydrogen Desorption from Lithium Borohydride and Manganese Chloride (3LiBH4 + MnCl2) Mixture", Int. J. Hydrogen Energy, 2010, pp. 3588-3597, vol. 35.

Wang et al., "Tin Nanoparticle Loaded Graphite Anodes for Li-Ion Battery Applications", Journal of the Electrochemical Society, Oct. 2004, pp. A1804-A1809, vol. 151, No. 11.

Wronski et al., "A New Nanonickel Catalyst for Hydrogen Storage in Solid-state Magnesium Hydrides", Int. J. Hydrogen Energy, 2011, pp. 1159-1166, vol. 36.

Yang et al. "Anisotropic Nanocrystalline MnBi With High Coercivity at High Temperature", Appl. Phys. Lett., 2011, 4 pgs, vol. 99, Article No. 082505.

Yang et al. "Temperature Dependences of Structure and Coercivity for Melt-spun MnBi Compound" J. Magnetism Magnet. Mat., 2013, pp. 106-110, vol. 330.

* cited by examiner

FERROMAGNETIC β-MNBI ALLOY

TECHNICAL FIELD

The present disclosure generally relates to ferromagnetic materials, and more particularly, to ferromagnetic manganese-bismuth.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Strong, permanent magnets, and in particular, so-called rare-earth magnets (containing rare earth elements and commonly referred to as Nd-magnets or SmCo-magnets) are critical to modern technology. For example, cell phones and other microelectronic devices, electric vehicles, and wind generators are all dependent on strong, permanent magnets and, in at present, mainly on rare earth magnets.

Because of the relative scarcity of rare earth elements, as their name implies, and their consequent expense, significant efforts have been undertaken to identify and develop alternative materials that have similar magnetic properties to rare earth magnets but that do not employ rare earth elements. Low Temperature Phase manganese-bismuth (LTP-MnBi) is one of the very few magnetic materials that does not use rare-earth elements and is predicted to be able to compete at these highest levels of permanent magnet performance, when properly packaged in a nanocomposite, with a soft magnetic phase.

Many applications require magnets to perform at relatively high temperatures. For example, the typical operating temperature of the electric motor in a hybrid/electric vehicle today approaches 200° C. Yet all magnets will experience a loss of bulk magnetic properties, such as magnetic coercivity, at sufficiently high temperatures; the temperature at which magnetic properties fade (referred to as Curie Temperature) depends on the composition of the magnet. For this reason, electric vehicle motors are typically equipped with temperature control systems that can limit motor output if the temperature rises above a pre-determined point. Among rare earth alternative magnets, LTP-MnBi has a magnetic coercivity maximum at about 175° C. to 225° C., with the highest reported value of 267° C.

In addition, upon heating to 355° C., bulk LTP undergoes a decomposition from ferromagnetic LTP MnBi to paramagnetic "high temperature phase" (HTP) $Mn_{1.08}Bi$. When the HTP is retained below 355° C. by rapid cooling, it is designated as the "quenched high temperature phase" (QTHP). QHTP has a Curie temperature of 177° C., and hence loses all the magnetic properties above 177° C.

Accordingly, it would be desirable to provide a rare earth alternative ferromagnetic material having bulk magnetic properties that are competitive with those of the rare earth magnets, and which maintains maximal bulk ferromagnetism at temperatures higher than does LTP-MnBi.

SUMMARY

This section provides a general summary of the disclosure, and is not a comprehensive disclosure of its full scope or all of its features.

In various aspects, the present teachings provide a method of making a novel phase of MnBi, termed β-MnBi, and having strong ferromagnetism at high temperature. The method includes a step of annealing MnBi nanoparticles at a temperature within a range of 100° C. to 175° C., at a pressure within a range of 30-120 MPa, for a duration within a range of 1 to 6 hours, wherein the annealing step produces a β-MnBi ferromagnetic phase having an NiAs-type unit cell with manganese populating interstitial spaces.

In other aspects, the present teachings provide a ferromagnetic composition of manganese and bismuth. The composition includes a β-MnBi phase alloy having an NiAs-type unit cell crystal structure with manganese populating interstitial spaces as shown by XAS, wherein the composition has a local magnetic coercivity maximum at about 350° C.

Further areas of applicability and various methods of enhancing the above coupling technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

Figure 1A:
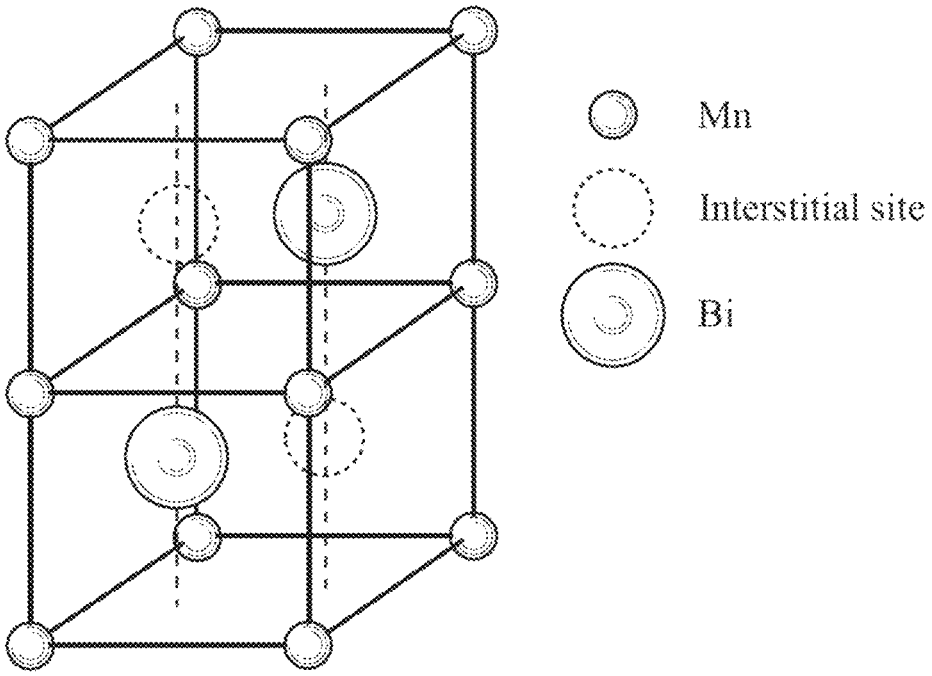
FIG. 1A is a schematic illustration, in perspective view, of an NiAs-type, LTP-MnBi unit cell.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present disclosure provides a novel ferromagnetic phase of manganese bismuth (MnBi) that possesses an unexpected and unusually high temperature maximum of temperature dependent coercivity, i.e. resistance to de-magnetization by an opposing magnetic field. All permanent magnets experience a loss of coercivity, thus becoming ineffective, at elevated temperature. However, because of its high temperature coercivity maximum, materials containing the manganese bismuth phase of the present disclosure can be especially adapted to high temperature magnetic applications.

The disclosed phase of MnBi has a NiAs-type unit cell similar to that of Low Temperature Phase manganese-bismuth (LTP-MnBi). In contrast to LTP-MnBi, the disclosed MnBi phase has manganese occupation of interstitial sites in the unit cell, conferring the unique ferromagnetic properties. In particular, a ferromagnetic phase of MnBi which retains ferromagnetic properties above 355° C. is disclosed. Since the present teachings clearly demonstrate ferromagnetism up to 427° C., the β-MnBi phase of the present disclosure has unique ferromagnetic properties within the temperature range of 355-427° C.

Methods for forming the disclosed phase of MnBi can include thermal annealing or hot compaction. The high temperature ferromagnetic phase will be referred to hereinafter as "β-MnBi", and thus the method can alternatively be referred to as a method for forming β-MnBi. The method includes a step of annealing MnBi nanoparticles at a temperature within a range of 100° C. to 175° C., for a duration within a range of 1 to 6 hours. The phrase "MnBi nanoparticles" generally refers to particles of a manganese-bismuth alloy, manganese and bismuth present at a molar ratio of approximately 1:1. The MnBi nanoparticles may have an average maximum dimension less than 100 nm.

In various aspects, the average maximum dimension of the MnBi nanoparticles can be determined by any suitable method, including but not limited to, x-ray diffraction (XRD), Transmission Electron Microscopy, Scanning Electron Microscopy, Atomic Force Microscopy, Photon Correlation Spectroscopy, Nanoparticle Surface Area Monitoring, Condensation Particle Counter, Differential Mobility Analysis, Scanning Mobility Particle Sizing, Nanoparticle Tracking Analysis, Aerosol Time of Flight Mass Spectroscopy, or Aerosol Particle Mass Analysis.

In some implementations, the average maximum dimension will be an average by mass, and in some implementations will be an average by population. In some instances, the MnBi nanoparticles can have an average maximum dimension less than about 50 nm, or less than about 40 nm, or less than about 30 nm, or less than about 20 nm, or even less than about 10 nm.

In some aspects, the average maximum dimension can have a relative standard deviation. In some such aspects, the relative standard deviation can be less than 0.1, and the MnBi nanoparticles can thus be considered monodisperse.

In some implementations, the annealing step can be performed at a temperature within a range of from about 125° C. to about 175° C. In other implementations, the annealing step can be performed at a temperature within a range of from about 150° C. to about 175° C. In still other implementations, the annealing step can be performed at a temperature within a range of from about 150° C. to about 160° C. In some implementations, the annealing step can be performed for a duration within a range of from about 2 to about 6 hours; in some implementations, for a duration within a range of from about 3 to about 6 hours; or in some implementations, for a duration within a range of from about 4 to about 6 hours.

In some implementations, the annealing step can be performed at constant pressure. In some implementations, the annealing step can be performed at elevated pressure, i.e. pressure greater than 1 atmosphere. In some implementations, the annealing step can be performed at a pressure within a range of 30-120 megaPascals (MPa). In some implementations, the annealing step can be performed at a pressure within a range of 60-80 MPa. In some implementations, the annealing step can be performed at a pressure of 60 MPa.

LTP-MnBi is known to exist exclusively in an NiAs-type, hexagonal unit cell crystal structure. FIG. 1A shows a schematic illustration, in perspective view, of the NiAs-type unit cell of LTP-MnBi. In FIG. 1A, large spheres represent bismuth atoms in the NiAs-type unit cell, small spheres represent manganese atoms, and dotted circles represent interstitial sites.

Figure 1B:
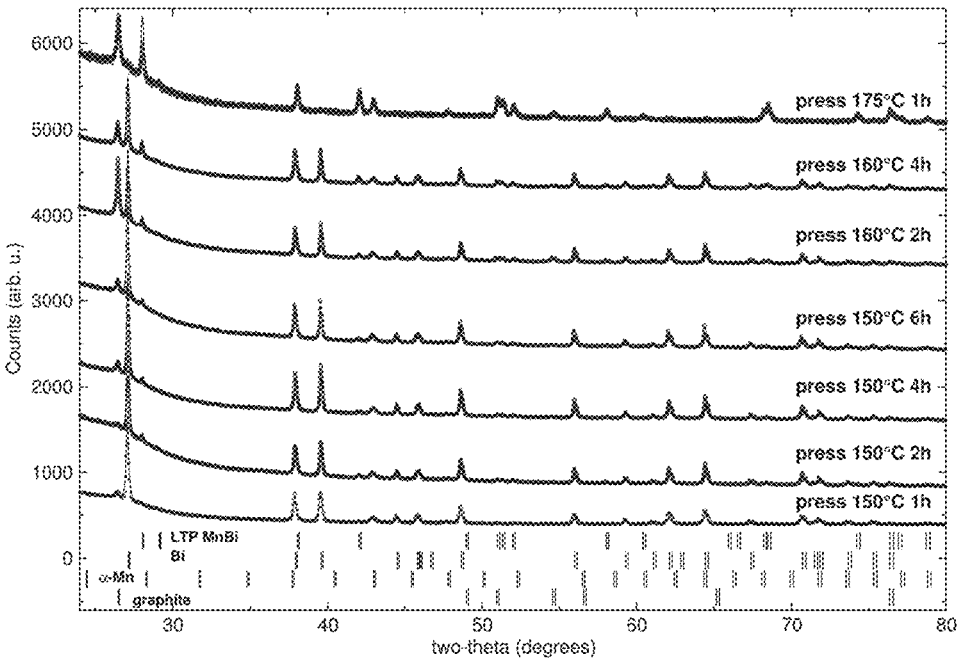
FIG. 1B is a series of x-ray diffraction (XRD) spectra of samples of MnBi nanoparticles annealed at constant pressure, at varying temperatures, and for varying durations.

FIG. 1B shows a series of x-ray diffraction (XRD) spectra of various samples of MnBi nanoparticles annealed according to the method for forming β-MnBi. Among the various samples of FIG. 1B, the annealing step is performed at constant pressure, at varying temperatures, and for varying durations, including zero duration, i.e. unannealed MnBi nanoparticles. The data were indexed against known diffraction spectra for unalloyed Mn, unalloyed Bi, and LTP-MnBi, the last being indicative of an NiAs-type unit cell. It is to be noted that the three index spectra, combined in varying proportions, modeled all observed reflections. The results strongly indicate that: (i) alloy formation is accentuated by increasing annealing duration and/or temperature within the monitored ranges, and (ii) the alloy(s) formed exist(s) exclusively in an NiAs-type unit cell crystal structure similar or identical to that shown in FIG. 1A.

Figure 2A:
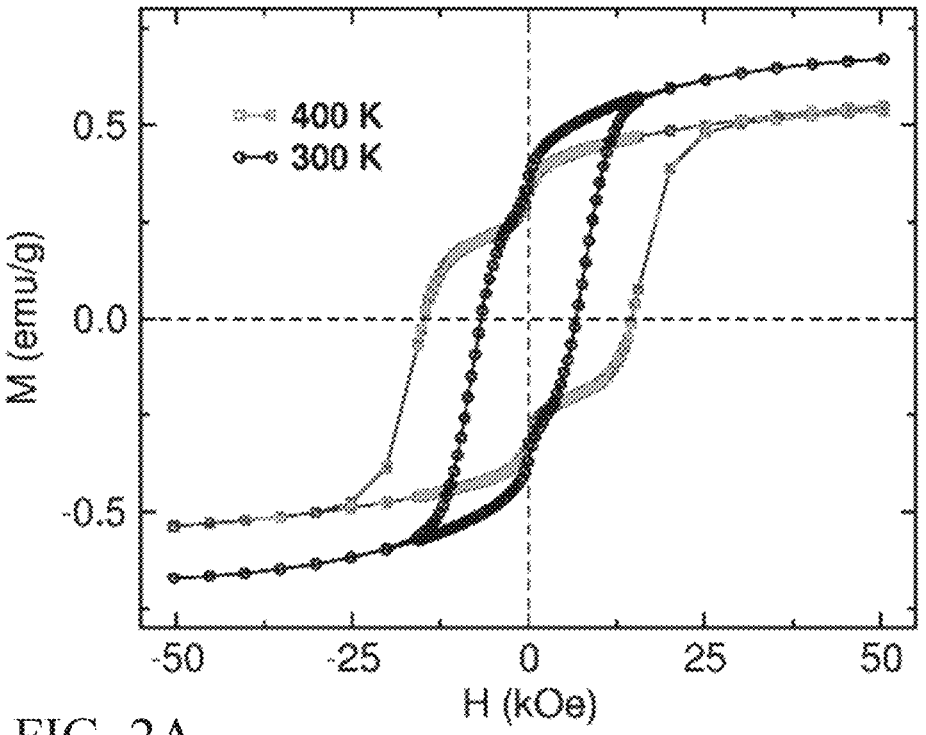
FIG. 2A presents two hysteresis [M(H)] loops of MnBi nanoparticles annealed at 150° C. for one hour, the hysteresis measured at 300 K or 400 K.

FIG. 2A illustrates hysteresis [M(H)] loops of MnBi nanoparticles annealed according to the method for forming β-MnBi. In the case of the sample examined in FIG. 2A, the MnBi nanoparticles were annealed at 150° C. for 1 hour, and the hysteresis loops were measured at 300 K and at 400 K. The hysteresis loops of FIG. 2A, particularly the hysteresis loop measured at 400 K, show an unexpected wasp-waisted shape, exemplified by the narrowing at low external field strength, H. This is indicative of multiple decoupled spin populations, and demonstrates that multiple ferromagnetic MnBi phases have been formed simultaneously during annealing. It is to be noted that unalloyed Mn and Bi are antiferromagnetic and diamagnetic, respectively, and therefore do not contribute to the shape of the hysteresis loops in FIG. 2A.

Figure 2B:
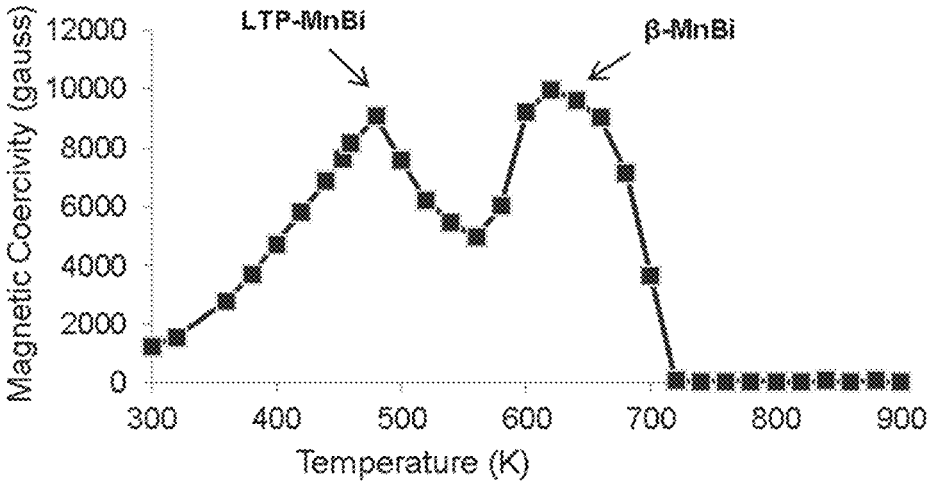
FIG. 2B is a plot of magnetic coercivity vs. temperature of the annealed MnBi nanoparticles of FIG. 2A.

Referring now to FIG. 2B, the determination of multiple ferromagnetic MnBi phases formed during annealing is supported by magnetic coercivity ($H_c$) measurements made at temperatures ranging from 300 K to 800 K. Specifically, the results shown in FIG. 2B reveal temperature-dependent $H_c$ maxima at two distinct measuring temperatures, indicating two distinct ferromagnetic phases of the annealed MnBi nanoparticles. The first ferromagnetic phase has an $H_c$ maximum at about 475 K, which decreases with continued heating above 500 K. This is consistent with the known temperature-dependent ferromagnetism of LTP-MnBi, and thus this peak can be assigned to LTP-MnBi formed during annealing. A second peak is observed having an $H_c$ maximum at about 625 K, about 150 K higher than that of LTP-MnBi.

The presence of the second peak establishes the formation of the novel phase of MnBi, β-MnBi, that is distinct from the well-known LTP-MnBi phase and possesses strong ferromagnetism at significantly higher temperature. Further studies, described below, probe the structural and electronic properties of β-MnBi.

Figure 3A:
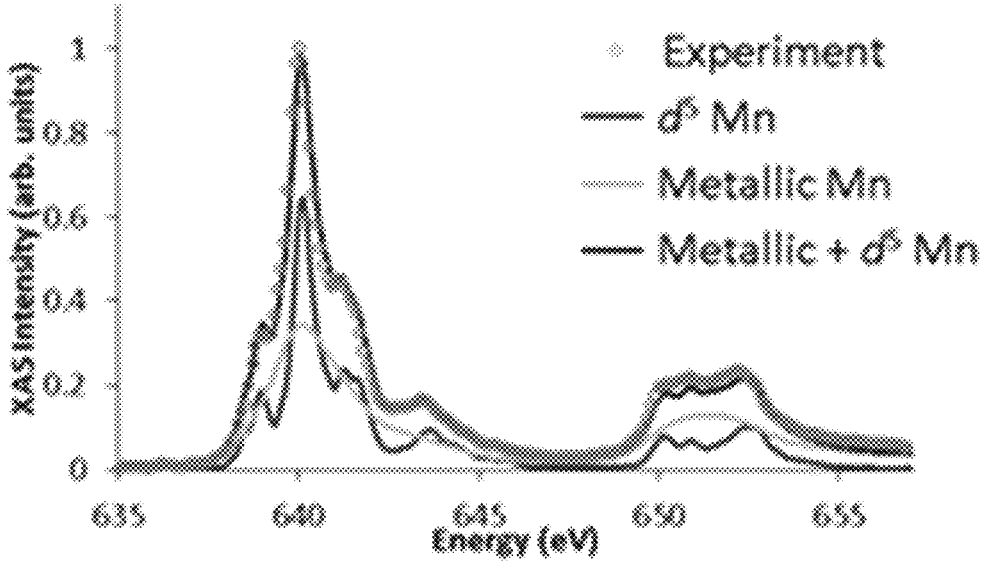
FIG. 3A is a graph of x-ray absorption spectroscopy (XAS) data of unannealed MnBi nanoparticles, along with a data fit showing spectral contributions from localized and delocalized valence electrons.
Figure 3B:
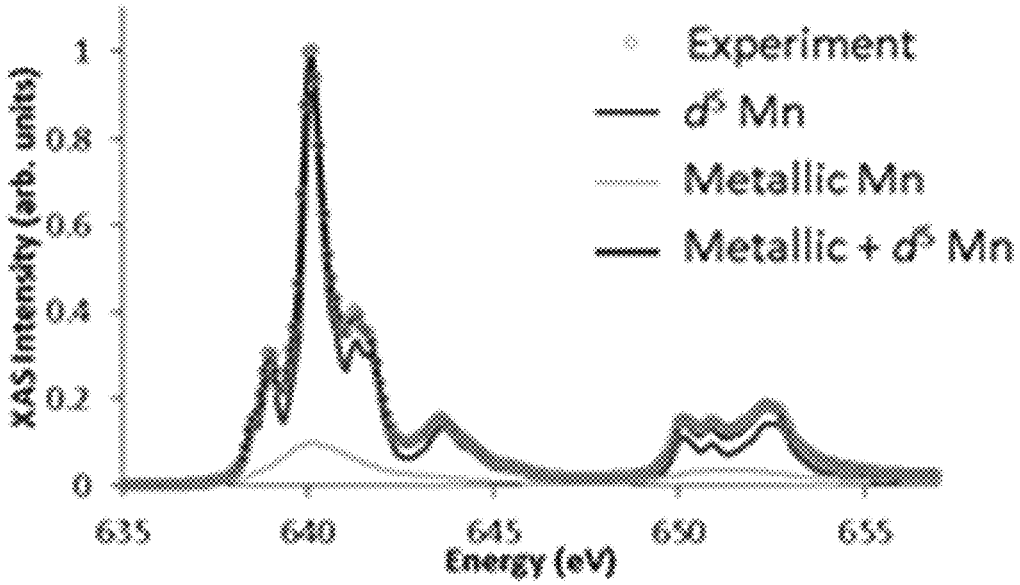
FIG. 3B is a graph of x-ray absorption spectroscopy (XAS) data of MnBi nanoparticles annealed at 160° C. for 4 hours, along with a data fit showing spectral contributions from localized and delocalized valence electrons.

X-ray absorption spectroscopy (XAS) spectra of unannealed MnBi nanoparticles (FIG. 3A), and of MnBi nanoparticles annealed at 160° C. for 4 hours (FIG. 3B), were measured to probe occupation of interstitial sites in the NiAs-type unit cell of MnBi (FIG. 1A). In particular, FIGS. 3A-B show spectra of the $L_2$ and $L_3$ edge transitions of Mn acquired at 10 K. The XAS of unannealed MnBi nanoparticles (FIG. 3A) indicate a large fraction of delocalized electrons, indicative of both un-alloyed α-Mn and LTP-MnBi, and exemplified by the broad smooth spectral features. By comparison, the annealed MnBi nanoparticles showed clear multiplet effects (FIG. 3B), indicating a second Mn species wherein the electrons are localized.

Simulations of the multiplet effects identified the localized site as $d^5$ Mn. Simulations of both the delocalized, metallic component and the localized $d^5$ component are overlaid with the acquired data in FIGS. 3A and 3B for reference. Because the delocalized Mn site describes both α-Mn metal prior to alloying and Mn sites in LTP-MnBi, the $d^5$ Mn must exist at the interstitial sites of the ferromagnetic β-MnBi, described previously by magnetometry (see FIGS. 2A and 2B), and formed during the annealing process.

Figure 4A:
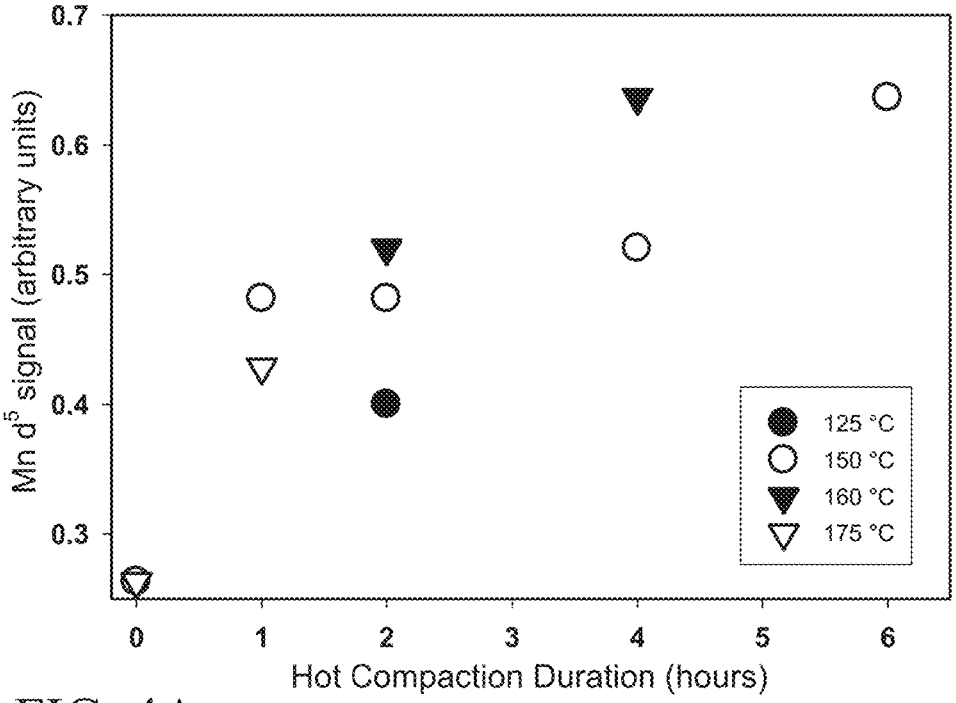
FIG. 4A is plot of manganese interstitial site occupation for MnBi nanoparticles annealed for varying durations and at varying temperatures, the plot based on XAS data of the type shown in FIGS. 3A and 3B.
Figure 4B:
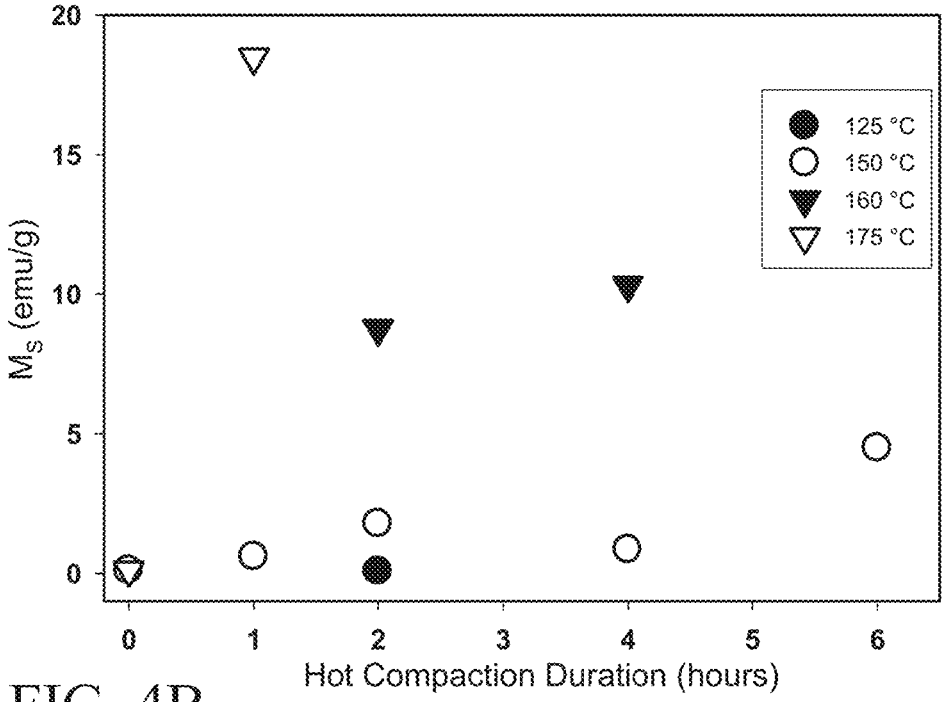
FIG. 4B is plot of the saturation magnetization (Ms) for MnBi nanoparticles annealed for varying durations and at varying temperatures, the plot based on hysteresis [M(H)] loops of the type shown in FIG. 2A, measured at 10 K.

The relative fraction of $d^5$ Mn (describing the β-MnBi ferromagnetic phase) vs metallic Mn fraction (describing α-Mn and LTP-MnBi), for different annealing conditions, is shown in FIG. 4A. A correlation of XAS and magnetometry data reveals that annealing for short periods of time results in a preferential LTP-MnBi phase formation, based on a constant $d^5$ fraction. The creation of β-MnBi is favored by longer annealing times. FIG. 4B shows the saturation magnetization (Ms) as a function of the same annealing conditions shown in FIG. 4A. FIG. 4B clearly shows that the saturation magnetization increases with increasing hot compaction duration and, particularly, with increasing hot compaction temperature. This observation indicates that ferromagnetic phases are formed during heat compaction. In addition, comparison of FIG. 4A to FIG. 4B shows that high temperature favors formation of LTP-MnBi, while compaction for longer duration favors β-MnBi. This is because high temperature compaction (e.g. 175° C.) shows a substantial increase in saturation magnetization without a corresponding increase in $d^5$ Mn proportion. By contrast, saturation magnetization and $d^5$ Mn increase proportionally to one another and to compaction duration, as is particularly evident at lower temperatures.

In some implementations, MnBi nanoparticles for use in the method for forming β-MnBi, can be obtained by a disclosed process for synthesizing MnBi nanoparticles. The process includes a step of adding cationic bismuth to a reagent complex of Formula I:

$$Mn^0.X_y.L_z \qquad \text{I,}$$

wherein $Mn^0$ is manganese, formally in oxidation state zero; X is a hydride molecule, L is a nitrile compound; y is an integral or fractional value greater than zero; and z is an integral or fractional value greater than zero. The complex of Formula I will alternatively be referred to as a "Manganese Ligated Anionic Element Reagent Complex", or Mn-LAERC.

As used herein, the term "hydride molecule" refers generally to any molecular species capable of functioning as a hydrogen anion donor. In different instances, a hydride molecule as referenced herein can be a binary metal hydride or "salt hydride" (e.g. NaH, or $MgH_2$), a binary metalloid hydride (e.g. $BH_3$), a complex metal hydride (e.g. $LiAlH_4$), or a complex metalloid hydride (e.g. $LiBH_4$ or $Li(CH_3CH_2)_3BH$). In some examples the hydride molecule will be $LiBH_4$. The term hydride molecule as described above can in some variations include a corresponding deuteride or tritide.

The phrase "nitrile compound", as used herein, refers to a molecule having the formula R—CN. In different implementations, R can be a substituted or unsubstituted alkyl or aryl group, including but not limited to: a straight-chain, branched, or cyclic alkyl or alkoxy; or a monocyclic or multicyclic aryl or heteroaryl. In some implementations, the R group of a nitrile compound will be a straight chain alkyl. In one particular implementation, the nitrile compound will be $CH_3(CH_2)_{10}CN$, alternatively referred to as dodecane nitrile or undecyl cyanide.

The value y according to Formula I defines the stoichiometry of hydride molecules to zero-valent manganese atoms in the complex. The value of y can include any integral or fractional value greater than zero. In some instances, 1:1 stoichiometry wherein y equals 1 may be useful. In other instances, a molar excess of hydride molecules to zero-valent manganese atoms, for example where y equals 2 or 4 may be preferred. A molar excess of hydride to zero-valent manganese can, in some instances, ensure that there is sufficient hydride present for subsequent applications. In some specific examples, y can be equal to 3.

The value z according to Formula I defines the stoichiometry of nitrile compound to zero-valent manganese atoms in the complex. The value of z can include any integral or fractional value greater than zero. In some instances, 1:1 stoichiometry wherein y equals 1 may be useful. In other instances, a molar excess of nitrile compound to zero-valent manganese atoms, for example where z equals 2 or 4 may be preferred. In some specific examples, z can be equal to 3.

In some specific implementations of the process for synthesizing manganese nanoparticles, the step of adding cationic bismuth to a Ligated Anionic Reagent Complex (LAERC) of Formula I will more specifically involve adding cationic bismuth to a reagent complex of Formula II:

$$Mn^0.Li(BH_4)_3.[CH_3(CH_2)_{10}CN]_3 \qquad \text{II.}$$

The complexes of the present disclosure can have any supramolecular structure, or no supramolecular structure. Without being bound to any particular structure, and without limitation, the complex could exist as a supramolecular cluster of many manganese atoms interspersed with hydride molecules and or nitrile compound. The complex could exist as a cluster of manganese atoms in which the cluster is surface-coated with hydride molecules and/or nitrile compound. The complex could exist as individual manganese atoms having little to no molecular association with one another, but each being associated with hydride molecules and nitrile compound according to Formula I or II. Any of these microscopic structures, or any other consistent with Formula I or II, is intended to be within the scope of the present disclosure.

In some variations of the process for synthesizing MnBi nanoparticles, the complex can be in solvated or suspended contact with a first solvent, the cationic bismuth can be in solvated or suspended contact with a second solvent, or both. In variations in which the complex is in solvated or suspended contact with a first solvent and the cationic bismuth is in solvated or suspended contact with a second solvent, the first and second solvents can either be the same or different solvents. When present, the first solvent can typically be a solvent that is non-reactive to the hydride molecule present in the complex, and when present, the second solvent can typically be a solvent in which the hydride molecule present in the complex is substantially soluble.

Non-limiting examples of suitable solvents that can serve as the first solvent, the second solvent, or both, include acetone, acetonitrile, benzene, 1-butanol, 2-butanol, 2-butanone, t-butyl alcohol, carbon tetrachloride, chlorobenzene, chloroform, cyclohexane, 1,2-dichloroethane, diethyl ether, diethylene glycol, diglyme (diethylene glycol, dimethyl ether), 1,2-dimethoxy-ethane (glyme, DME), dimethylether, dimethyl-formamide (DMF), dimethyl sulfoxide (DMSO), dioxane, ethanol, ethyl acetate, ethylene glycol, glycerin, heptane, Hexamethylphosphoramide (HMPA), Hexamethylphosphorous triamide (HMPT), hexane, methanol, methyl t-butyl ether (MTBE), methylene chloride, N-methyl-2-pyrrolidinone (NMP), nitromethane, pentane, Petroleum ether (ligroine), 1-propanol, 2-propanol, pyridine, tetrahydrofuran (THF), toluene, triethyl amine, o-xylene, m-xylene, or p-xylene.

In some particular examples, toluene is employed as a first solvent and a second solvent.

In some variations, the process for synthesizing MnBi nanoparticles can include a step of contacting the complex of Formula I with a free surfactant. In variations which include the step of contacting the complex of Formula I with a free surfactant, the contacting step can be performed prior to, simultaneous to, or subsequent to the step of adding cationic bismuth.

Without being bound by any particular mechanism, it is believed that upon addition of cationic bismuth to the complex (Mn-LAERC), the hydride molecule incorporated into the complex can reduce the cationic bismuth to elemental bismuth which then alloys with or combines with the manganese. In some aspects of the process for synthesizing MnBi nanoparticles, it may be desirable to ensure that sufficient equivalents of hydride molecule are present in the reagent complex to reduce the added cationic bismuth to oxidation state zero. In some instances it may be desirable to add additional equivalents of the hydride molecule to the reagent complex, either prior or simultaneous to addition of the cationic bismuth.

When used, a free surfactant employed in the process for synthesizing MnBi nanoparticles can be any known in the art. Non-limiting examples of suitable free surfactants can include nonionic, cationic, anionic, amphoteric, zwitterionic, polymeric surfactants and combinations thereof. Such surfactants typically have a lipophilic moiety that is hydrocarbon based, organosilane based, or fluorocarbon based. Without implying limitation, examples of types of surfactants which can be suitable include alkyl sulfates and sulfonates, petroleum and lignin sulfonates, phosphate esters, sulfosuccinate esters, carboxylates, alcohols, ethoxylated alcohols and alkylphenols, fatty acid esters, ethoxylated acids, alkanolamides, ethoxylated amines, amine oxides, nitriles, alkyl amines, quaternary ammonium salts, carboxybetaines, sulfobetaines, or polymeric surfactants. In some variations, the bismuth cation can be present as part of a bismuth salt having an anionic surfactant, such as an acyl anion. A non-limiting example of a bismuth salt in such a variation is bismuth neodecanoate.

In some instances in which a free surfactant is used, the free surfactant will be one capable of oxidizing, protonating, or otherwise covalently, datively, or ionically modifying the hydride molecule incorporated in the complex.

In some variations, the process for synthesizing MnBi nanoparticles can be performed under an anhydrous environment, under an oxygen-free environment, or under an environment that is anhydrous and oxygen-free. For example, the process for synthesizing MnBi nanoparticles can be performed under argon gas or under vacuum.

In some implementations, a reagent of Formulae I, including Formula I, can be obtained by ball-milling a mixture that includes manganese powder, a hydride molecule, and a nitrile. Performance of the ball-milling step will generally produce an Mn-LAERC as defined above by Formula I or, in some cases, more specifically by Formula II.

In some instances, the ball-milling step can be performed in an oxygen-free environment, in an anhydrous environment, or in an environment that is oxygen-free and anhydrous, such as under argon or under vacuum. An oxygen-free and/or anhydrous environment can potentially limit undesired oxidation of the resulting ligated reagent complex.

In some instances, the mixture to be ball-milled can include a 1:1:1 molar ratio of manganese atoms in the manganese powder, hydride molecules, and nitrile compounds. In some instances, the mixture can include hydride molecules, nitrile compounds, or both in molar excess relative to manganese atoms. In some such instances, such molar excess can be about 4-fold or less. In some instances, the mixture to be ball-milled can include a 1:3:3 molar ratio of manganese atoms in the manganese powder, hydride molecules, and nitrile.

It is to be understood that the phrase "manganese powder" includes any composition composed substantially of manganese.

Without being bound by any particular theory, it is believed that the nitrile, L, of the disclosed ligated reagent complex can function to ablate or otherwise assist in decreasing the particle size of the manganese powder and/or the reagent complex.

Also disclosed is a manganese-bismuth composition possessing a novel crystal structure, referred to as β-MnBi as characterized above with respect to the method for forming β-MnBi. The disclosed manganese-bismuth composition is an alloy of manganese and bismuth, present at a molar ratio within a range of 0.9:1 to 1.1:1. The disclosed β-MnBi is present having an NiAs-type, hexagonal unit cell (FIG. 1A) in which manganese atoms populate the interstitial sites. In some implementations, a disclosed manganese-bismuth composition can include a component of β-MnBi in addition to other components, such as a component of LTP-MnBi and components of unalloyed Mn and Bi.

In some implementations, a disclosed manganese-bismuth composition has a local maximum of temperature-dependent magnetic coercivity at a temperature greater than 600 K (325° C.) and in some cases a local maximum at about 625 K (350° C.). In some implementations, a disclosed manganese-bismuth composition has a global maximum of temperature dependent magnetic coercivity at a temperature greater than 600 K (325° C.) and in some cases a global maximum at about 625 K (350° C.). In some implementations, a disclosed manganese-bismuth composition shows also ferromagnetism up to about 700 K (427° C.).

The present invention is further illustrated with respect to the following examples. It needs to be understood that these examples are provided to illustrate specific embodiments of the present invention and should not be construed as limiting the scope of the present invention.

Example 1. Synthesis of MnBi Nanoparticles

Mn-LAERC is synthesized in the following manner. To a ball mill jar is added balls, 2.4558 g undecyl cyanide, 3 mL toluene, 0.249 g Mn powder (−325 mesh), and 0.295 g $LiBH_4$ powder. This reaction mixture was then milled for 4 hours. A solution of 12.984 g of bismuth (neodecanoate)$_3$ is dissolved in 333 mL of toluene. This bismuth solution is added to a solution of 12.001 g Mn-LAERC in 320 mL of toluene. The product is collected and washed.

Example 2. Formation of β-MnBi Via Annealing

MnBi nanoparticles as prepared in Example 1 are heated for 1 to 6 hours between 100° C. and 175° C., while being subjected to a pressure range of 40 to 60 MPa.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

What is claimed is:

1. A method of making β-MnBi, the method comprising:

annealing MnBi nanoparticles at a temperature within a range of from 100° C. to 175° C., at a pressure within a range of from 30 MPa to 120 MPa, for a duration within a range of from 1 to 6 hours, wherein the annealing step produces a β-MnBi ferromagnetic phase having a NiAs-type unit cell with manganese populating interstitial spaces.

2. The method as recited in claim 1, further comprising producing the MnBi nanoparticles by:

adding cationic bismuth to a reagent complex having a formula:

$$Mn^0.X_y.L_z,$$

wherein $Mn^0$ is manganese, formally in oxidation state zero; X is a hydride molecule, L is a nitrile compound; y is an integral or fractional value greater than zero; and z is an integral or fractional value greater than zero.

3. The method as recited in claim 1, comprising annealing the MnBi nanoparticles for a duration equal to or greater than 2 hours.

4. The method as recited in claim 1, comprising annealing the MnBi nanoparticles for a duration equal to or greater than 4 hours.

5. The method as recited in claim 1, comprising annealing the MnBi nanoparticles at a temperature within a range of from 150° C. to 160° C.

6. The method as recited in claim 1, comprising annealing the MnBi nanoparticles at a pressure within a range of from 60 MPa to 80 MPa.

7. The method as recited in claim 1, comprising annealing the MnBi nanoparticles at a pressure of 60 MPa.

8. A ferromagnetic composition of manganese and bismuth, the composition comprising a β-MnBi phase alloy having a NiAs-type unit cell crystal structure with manganese populating interstitial spaces as shown by x-ray absorption spectroscopy (XAS), wherein the composition has a local magnetic coercivity maximum at a temperature greater than 325° C.

9. The ferromagnetic composition of manganese and bismuth as recited in claim 8, having a global magnetic coercivity maximum at a temperature greater than 325° C.

* * * * *